United States Patent [19]

Reisdorf

[11] 3,955,971

[45] May 11, 1976

[54] ALLOY STEEL FOR ARCTIC SERVICE

[75] Inventor: Bartholomew G. Reisdorf, Penn Hills Borough, Pa.

[73] Assignee: United States Steel Corporation, Pittsburgh, Pa.

[22] Filed: Dec. 11, 1974

[21] Appl. No.: 531,653

[52] U.S. Cl. ..... 75/124; 75/125; 75/128 W; 148/36

[51] Int. Cl.[2] ..... C22C 38/06; C22C 38/16; C22C 38/22

[58] Field of Search ..... 75/124, 125, 128 W; 148/36, 12 F

[56] References Cited

UNITED STATES PATENTS

| | | | |
|---|---|---|---|
| 2,586,042 | 2/1952 | Hodge et al. | 148/36 X |
| 2,797,162 | 6/1957 | Korczynsky | 75/124 |
| 3,110,586 | 11/1963 | Gulya et al. | 75/124 X |
| 3,235,413 | 2/1966 | Grange et al. | 148/36 X |
| 3,310,441 | 3/1967 | Mandich | 148/36 |
| 3,438,822 | 4/1969 | Allen | 148/36 X |
| 3,573,898 | 4/1971 | Murai et al. | 75/124 |
| 3,592,633 | 7/1971 | Osuka et al. | 75/124 |
| 3,620,717 | 11/1971 | Sekino et al. | 75/124 X |
| 3,692,514 | 9/1972 | Hydrean | 75/124 |

*Primary Examiner*—L. Dewayne Rutledge
*Assistant Examiner*—Arthur J. Steiner
*Attorney, Agent, or Firm*—Forest C. Sexton

[57] ABSTRACT

A weldable, low-alloy steel for Arctic service consisting essentially of 0.06 to 0.12% carbon, 0.40 to 1.00% manganese, 0.75 to 1.50% nickel, 0.50 to 1.25% chromium, 0.15 to 0.40% molybdenum, and up to 0.75% copper, with total copper plus chromium not exceeding 1.50% max.

7 Claims, No Drawings

ALLOY STEEL FOR ARCTIC SERVICE

BACKGROUND OF THE INVENTION

The development of oil and gas fields in the Arctic had encouraged a search for structural steels having good low-temperature properties for such applications as line pipe, line-pipe fittings and critical bridge members. The low-cost carbon and high strength, low-alloy steels currently used for these applications in warmer environments do not have the desired toughness at low temperatures in section thicknesses of about 1 to 2 inches. For such Arctic applications, it will be necessary that the structural steel have a minimum yield strength of at least 60 ksi, and good impact toughness down to temperatures as low as −80°F.

Although many low-alloy and alloy steels are known which have excellent low temperature properties, more than sufficient to meet the above requirements, such as the "T-1" steels and the 3 to 9% nickel cryogenic steels, these prior art steels provide properties far in excess of those desired and are therefore too expensive for high tonnage applications such as line pipe. In addition, many of these steels are quenched and tempered martensitic grades many of which are difficult to weld in the field.

SUMMARY OF THE INVENTION

This invention is predicated on the development of a relatively inexpensive low alloy steel ideally suited for Arctic applications. This weldable, low-alloy steel is characterized in the quenched condition by a ferritic-pearlitic-bainitic microstructure which in the tempered condition has a minimum yield strength of about 65 ksi in plate thicknesses to at least 2 inches, and a Charpy V-notch 50 percent shear-transition temperature below −80°F, and a Charpy V-notch energy absorption of at least 50 ft.-lb. in both the longitudinal and transverse directions.

An object of this invention, therefore, is to provide an inexpensive low-alloy steel suitable for Arctic applications.

Another object of this invention is to provide a low-cost weldable low-alloy steel having a non-martensitic microstructure in the quenched and tempered condition characterized by a minimum yield strength in excess of 60 ksi and excellent impact properties at −80°F.

DESCRIPTION OF THE PREFERRED EMBODIMENTS

In accordance with the present invention a steel is provided having a composition within the following range:

| | |
|---|---|
| carbon | 0.06 to 0.12% |

-continued

| | |
|---|---|
| manganese | 0.20 to 1.00% |
| phosphorus | 0.020% max. |
| sulfur | 0.015% max. |
| silicon | 0.15 to 0.40% |
| nickel | 0.75 to 1.50% |
| chromium | 0.50 to 1.25% |
| molybdenum | 0.15 to 0.40% |
| aluminum | 0.010 to 0.060% |
| copper | 0.75% max. |
| copper plus chromium | 1.50% max. |

iron and conventional impurities — balance

In the quenched and tempered condition, at least in thicker sections (i.e. ⅝-inch and greater) the above composition will render a ferritic-pearlitic-bainitic microstructure. Unlike the quenched and tempered low-carbon constructional alloy steels, like ASTM A514 and A517, the above steel is not characterized by high hardenability and is not martensitic in the quenched condition. Indeed, lower yield strengths are achieved but low temperature toughness is improved. The quenched and tempered low-carbon ultraservice steels, such as HY-80, can be similarly distinguished in addition to containing considerably more carbon and total alloy content.

The steel of this invention has a generally lower carbon content than any of the prior art quenched and tempered martensitic grades. Although at least 0.06% carbon is essential to assure the desired strength, more than 0.12% carbon will increase strength levels by sacrificing low temperature toughness. The steel's low-temperature toughness is primarily due to the 0.75 to 1.50% nickel content. Although nickel is well known for its ability to improve low-temperature toughness, it is not believed such small amounts had been recognized as beneficial. The small quantity of chromium, in addition to improving corrosion resistance, will improve the steel's strength values. Although strength can be further enhanced with chromium in excess of 1.25 percent, this will cause a sacrifice in toughness. The molybdenum serves not only as a grain refiner, but primarily serves to resist softening upon tempering or stress relieving. Although copper-free versions may be desired for the sake of economy, slightly better properties can be achieved by substituting some copper up to 0.75% copper, for the chromium. To avoid sacrificing toughness however, the total copper plus chromium should not exceed 1.50 percent.

To aid in a fuller understanding of this invention, the results of eight trial heats are illustrated below. Table I below shows the chemical composition of the eight heats from which 1- and 2-inch-thick plates were produced. Plate samples of each were austenitized at 1650°F and water quenched. The samples were then tempered at 1150°F and at 1250°F. The results of tension tests on these plates are shown in Table II, while the results of Charpy V-notch impact tests are shown in Table III.

Table I

Chemical Composition of the Conventionally Heat-Treated Steels—Percent (Check Analyses)

| Steel | C | Mn | P | S | Si | Cu | Ni | Cr | Mo | V | Al | N |
|---|---|---|---|---|---|---|---|---|---|---|---|---|
| 24 | 0.083 | 0.60 | 0.010 | 0.010 | 0.24 | — | 0.98 | 0.50 | 0.30 | — | 0.024 | 0.007 |
| 25 | 0.093 | 0.60 | 0.010 | 0.011 | 0.24 | — | 1.50 | 0.51 | 0.30 | — | 0.026 | 0.007 |
| 26 | 0.086 | 0.56 | 0.010 | 0.011 | 0.23 | 0.49 | 0.98 | 0.50 | 0.30 | — | 0.023 | 0.007 |
| 27 | 0.084 | 0.59 | 0.010 | 0.010 | 0.24 | — | 1.00 | 0.99 | 0.30 | — | 0.026 | 0.007 |
| 28 | 0.076 | 0.59 | 0.009 | 0.010 | 0.24 | — | 0.98 | 0.50 | 0.30 | 0.081 | 0.023 | 0.007 |
| 29 | 0.078 | 0.60 | 0.010 | 0.010 | 0.23 | — | 0.99 | 0.50 | 0.30 | 0.081 | 0.024 | 0.011 |
| 30 | 0.076 | 0.98 | 0.010 | 0.010 | 0.24 | — | 0.98 | 0.49 | 0.31 | — | 0.023 | 0.007 |

Table I-continued

| Chemical Composition of the Conventionally Heat-Treated Steels—Percent (Check Analyses) | | | | | | | | | | | | |
|---|---|---|---|---|---|---|---|---|---|---|---|---|
| Steel | C | Mn | P | S | Si | Cu | Ni | Cr | Mo | V | Al | N |
| 31 | 0.12 | 0.60 | 0.010 | 0.011 | 0.23 | — | 0.98 | 0.50 | 0.30 | — | 0.025 | 0.007 |

Table II

| Steel Code | Tension-Test Results: Yield Strength, (0.2% Offset), ksi | Tensile Strength, ksi | Elongation in 2 In., % | Reduction of Area, % |
|---|---|---|---|---|
| 1-Inch-Thick Plate Tempered for 1 Hour at 1150 F | | | | |
| 24 | 71.9 | 85.8 | 26.5 | 78.2 |
| 25 | 77.4 | 91.0 | 25.5 | 74.8 |
| 26 | 75.3 | 89.6 | 25.8 | 75.6 |
| 27 | 75.2 | 89.0 | 25.2 | 78.7 |
| 28 | 84.4 | 98.2 | 24.0 | 74.9 |
| 29 | 86.7 | 99.8 | 24.0 | 74.6 |
| 30 | 74.8 | 87.9 | 25.2 | 78.9 |
| 31 | 77.5 | 92.6 | 25.0 | 74.6 |
| 1-Inch-Thick Plate Tempered for 1 Hour at 1250 F | | | | |
| 24 | 67.3 | 81.3 | 27.8 | 78.6 |
| 25 | 70.5 | 85.5 | 27.5 | 77.8 |
| 26 | 69.4 | 84.2 | 27.5 | 77.9 |
| 27 | 68.5 | 83.5 | 27.8 | 78.8 |
| 28 | 84.8 | 96.2 | 25.2 | 76.4 |
| 29 | 83.5 | 95.0 | 24.8 | 75.4 |
| 30 | 68.7 | 83.2 | 28.0 | 78.6 |
| 31 | 70.8 | 87.0 | 26.0 | 76.3 |

Table II-continued

| Steel Code | Tension-Test Results: Yield Strength, (0.2% Offset), ksi | Tensile Strength, ksi | Elongation in 2 In., % | Reduction of Area, % |
|---|---|---|---|---|
| 2-Inch-Thick Plate Tempered for 2 Hours at 1150 F | | | | |
| 24 | 67.6 | 82.0 | 26.8 | 79.2 |
| 25 | 72.0 | 86.9 | 25.5 | 76.1 |
| 26 | 72.1 | 86.2 | 26.8 | 76.0 |
| 27 | 73.9 | 88.2 | 25.2 | 76.6 |
| 28 | 81.6 | 95.5 | 25.0 | 75.4 |
| 29 | 77.4 | 91.4 | 26.2 | 77.0 |
| 30 | 70.4 | 84.5 | 26.5 | 78.3 |
| 31 | 72.5 | 88.4 | 25.5 | 75.2 |
| 2-Inch-Thick Plate Tempered for 2 Hours at 1250 F | | | | |
| 24 | 64.6 | 79.8 | 28.2 | 77.8 |
| 25 | 68.0 | 83.6 | 27.5 | 76.8 |
| 26 | 67.6 | 83.0 | 28.2 | 77.6 |
| 27 | 65.8 | 82.0 | 28.0 | 79.8 |
| 28 | 82.4 | 94.5 | 25.0 | 76.4 |
| 29 | 81.8 | 94.1 | 25.0 | 75.1 |
| 30 | 66.8 | 81.8 | 28.5 | 77.7 |
| 31 | 68.4 | 84.9 | 26.5 | 74.6 |

Table III

| Steel | Direction | Charpy V-Notch Impact Test Results: −80 F Energy Absorbed, ft-lb | −80 F Shear-Fracture Appearance, % | −80 F Lateral Expansion, mils | −50 F Energy Absorbed, ft-lb | −50 F Shear-Fracture Appearance, % | −50 F Lateral Expansion, mils | −20 F Energy Absorbed, ft-lb | −20 F Shear-Fracture Appearance, % | −20 F Lateral Expansion, mils | 50% Shear-Fracture Appearance Temperature, F |
|---|---|---|---|---|---|---|---|---|---|---|---|
| 1-Inch-Thick Plate Tempered for 1 Hour at 1150 F | | | | | | | | | | | |
| 24 | L | 192 | 100 | 93 | * | * | * | * | * | * | −145 |
| | T | 150 | 83 | 92 | * | * | * | * | * | * | −110 |
| 25 | L | 160 | 85 | 92 | * | * | * | * | * | * | −110 |
| | T | 112 | 55 | 75 | 136 | 85 | 88 | * | * | * | −85 |
| 26 | L | 160 | 87 | 93 | 178 | 100 | 95 | * | * | * | −135 |
| | T | 120 | 55 | 82 | 150 | 100 | 92 | * | * | * | −90 |
| 27 | L | 195 | 100 | 98 | 205 | 100 | 95 | * | * | * | −125 |
| | T | 167 | 82 | 96 | * | * | * | * | * | * | −100 |
| 28 | L | 100 | 35 | 70 | 114 | 37 | 80 | 124 | 50 | 82 | −10 |
| | T | 82 | 30 | 57 | 110 | 42 | 72 | 125 | 52 | 80 | −25 |
| 29 | L | 98 | 28 | 68 | 106 | 32 | 70 | 117 | 52 | 80 | −20 |
| | T | 62 | 25 | 60 | 84 | 35 | 67 | 100 | 52 | 75 | −30 |
| 30 | L | 160 | 77 | 93 | * | * | * | * | * | * | −130 |
| | T | 130 | 40 | 83 | 157 | 83 | 90 | * | * | * | −75 |
| 31 | L | 140 | 70 | 90 | 170 | 85 | 95 | 180 | 100 | 95 | −120 |
| | T | 102 | 50 | 69 | 117 | 62 | 77 | 140 | 85 | 85 | −75 |
| 1-Inch-Thick Plate Tempered for 1 Hour at 1250 F | | | | | | | | | | | |
| 24 | L | 217 | 100 | 97 | * | * | * | * | * | * | −145 |
| | T | 181 | 100 | 94 | * | * | * | * | * | * | −115 |
| 25 | L | 138 | 92 | 94 | * | * | * | * | * | * | −145 |
| | T | 130 | 72 | 79 | 137 | 83 | 87 | * | * | * | − 100 |
| 26 | L | 178 | 100 | 96 | * | * | * | * | * | * | −135 |
| | T | 180 | 100 | 97 | * | * | * | * | * | * | −115 |
| 27 | L | 210 | 100 | 95 | * | * | * | * | * | * | −150 |
| | T | 198 | 100 | 96 | * | * | * | * | * | * | −125 |
| 28 | L | 117 | 40 | 82 | 150 | 65 | 93 | 165 | 100 | 98 | −60 |
| | T | 100 | 32 | 74 | 130 | 50 | 85 | 153 | 92 | 92 | −50 |
| 29 | L | 96 | 45 | 63 | 125 | 62 | 77 | 150 | 80 | 90 | −70 |
| | T | 107 | 40 | 68 | 122 | 50 | 77 | 135 | 62 | 84 | −50 |
| 30 | L | 218 | 100 | 96 | * | * | * | * | * | * | −145 |
| | T | 155 | 68 | 88 | 170 | 82 | 90 | * | * | * | −105 |
| 31 | L | 165 | 80 | 95 | 188 | 100 | 90 | * | * | * | −130 |
| | T | 120 | 66 | 78 | 144 | 82 | 88 | 157 | 100 | 93 | −95 |
| 2-Inch-Thick Plate Tempered for 2 Hours at 1150 F | | | | | | | | | | | |
| 24 | L | 159 | 83 | 94 | 177 | 100 | 97 | 185 | 100 | 95 | −115 |
| | T | 119 | 61 | 80 | 136 | 76 | 88 | 147 | 87 | 90 | −100 |
| 25 | L | 140 | 65 | 86 | 150 | 80 | 93 | 158 | 93 | 94 | −100 |
| | T | 80 | 31 | 58 | 102 | 58 | 70 | 147 | 100 | 92 | −60 |
| 26 | L | 115 | 67 | 72 | 139 | 88 | 82 | 158 | 100 | 91 | −100 |
| | T | 115 | 70 | 76 | 140 | 95 | 89 | 158 | 100 | 94 | −100 |
| 27 | L | 183 | 100 | 95 | 187 | 100 | 95 | 187 | 100 | 93 | −120 |
| | T | 87 | 36 | 54 | 111 | 55 | 66 | 168 | 100 | 93 | −60 |
| 28 | L | 90 | 24 | 67 | 101 | 34 | 82 | 111 | 43 | 81 | 10 |

Table III-continued

| Steel | Direction | −80 F Energy Absorbed, ft-lb | −80 F Shear-Fracture Appearance, % | −80 F Lateral Expansion, mils | −50 F Energy Absorbed, ft-lb | −50 F Shear-Fracture Appearance, % | −50 F Lateral Expansion, mils | −20 F Energy Absorbed, ft-lb | −20 F Shear-Fracture Appearance, % | −20 F Lateral Expansion, mils | 50% Shear-Fracture Appearance Temperature, F |
|---|---|---|---|---|---|---|---|---|---|---|---|
| | T | 57 | 16 | 37 | 80 | 28 | 49 | 95 | 40 | 60 | 10 |
| 29 | L | 69 | 26 | 48 | 92 | 41 | 61 | 115 | 55 | 73 | −30 |
| | T | 80 | 25 | 55 | 98 | 40 | 67 | 114 | 54 | 80 | −30 |
| 30 | L | 115 | 57 | 85 | 129 | 80 | 90 | 163 | 100 | 94 | −90 |
| | T | 109 | 55 | 77 | 129 | 77 | 84 | 149 | 100 | 90 | −85 |
| 31 | L | 108 | 55 | 74 | 128 | 74 | 84 | 143 | 87 | 90 | −85 |
| | T | 69 | 36 | 50 | 95 | 52 | 65 | 113 | 67 | 77 | −55 |
| 2-Inch-Thick Plate Tempered for 2 Hours at 1250 F | | | | | | | | | | | |
| 24 | L | 156 | 70 | 92 | 172 | 90 | 92 | 183 | 100 | 91 | −105 |
| | T | 104 | 50 | 68 | 132 | 75 | 84 | 160 | 100 | 91 | −80 |
| 25 | L | 148 | 72 | 88 | 180 | 100 | 94 | 193 | 100 | 94 | −105 |
| | T | 106 | 52 | 62 | 131 | 81 | 80 | 146 | 100 | 90 | −80 |
| 26 | L | 100 | 56 | 70 | 132 | 79 | 83 | 154 | 100 | 92 | −85 |
| | T | 107 | 53 | 71 | 128 | 75 | 78 | 164 | 100 | 92 | −85 |
| 27 | L | 194 | 100 | 95 | 205 | 100 | 93 | 210 | 100 | 92 | −115 |
| | T | 150 | 70 | 85 | 192 | 100 | 95 | 191 | 100 | 94 | −90 |
| 28 | L | 60 | 18 | 42 | 87 | 36 | 59 | 104 | 52 | 70 | −20 |
| | T | 72 | 24 | 50 | 93 | 30 | 61 | 102 | 37 | 72 | −5 |
| 29 | L | 58 | 16 | 40 | 80 | 41 | 55 | 100 | 66 | 65 | −40 |
| | T | 66 | 29 | 45 | 90 | 47 | 62 | 110 | 66 | 76 | −45 |
| 30 | L | 160 | 67 | 92 | 180 | 100 | 92 | 180 | 100 | 92 | −95 |
| | T | 90 | 25 | 59 | 127 | 69 | 84 | 146 | 100 | 85 | −65 |
| 31 | L | 110 | 58 | 76 | 139 | 88 | 84 | 163 | 100 | 94 | −90 |
| | T | 62 | 31 | 45 | 81 | 49 | 58 | 125 | 100 | 86 | −50 |

*Not determined.

Except for steels 28 and 29, which contained 0.08% vanadium, the toughness of all the steels was quite good at −80°F, and all were characterized by yield strengths in excess of 65 ksi. Of the copper-free steels, steel 27 was the best with approximately 1% each of nickel and chromium and about 0.3% molybdenum. Steel number 26 with about 0.5% copper and 0.5% chromium was slightly better than steel number 27.

Since steel number 27 suggested that the optimum chemical composition would be about 1% each of nickel and chromium and 0.3% molybdenum for a copper-free steel, another heat was prepared with this aim and processed to 1-inch-thick plate. The composition achieved in this steel was 0.10% C, 0.59% Mn, 0.007% P, 0.008% S, 0.23% Si, 0.01% Cu, 0.99% Ni, 0.99% Cr, 0.29% Mo, less than 0.005% V, 0.035% Al and 0.006% N. Samples of this one-inch plate were austenitized at 1650°F for 1 hour, water quenched, and then tempered at 1200°F for one hour and air cooled. The results of tensile and impact tests are shown in Table IV below.

Table IV

| Tensile Properties Heat-Treated Plate[1] | | | |
|---|---|---|---|
| Yield Strength, ksi | Tensile Strength, ksi | Elongation in 1.4 Inches, % | Reduction of Area, % |
| 78.4 | 93.0 | [2] | 80.4 |

Table IV-continued

| Tensile Properties Heat-Treated Plate[1] | | | |
|---|---|---|---|
| Yield Strength, ksi | Tensile Strength, ksi | Elongation in 1.4 Inches, % | Reduction of Area, % |
| **Transverse CVN Impact Properties** | | | |
| Test Temperature, F | Energy Absorbed, ft-lb | Shear-Fracture Appearance, % | Lateral Expansion, mils |
| −80 | 192, 197, 206 | 100, 100, 100 | 96, 95, 95 |
| −100 | — | — | — |
| −120 | 179, 140, 169 | 100, 65, 85 | 96, 83, 90 |
| −140 | 107, 96, 130 | 50, 50, 60 | 68, 61, 74 |

[1]Longitudinal tests of 0.357-inch-diameter specimens.
[2]Both test specimens broke at gage marks.

Because of the above favorable results, an 80-ton commercial heat was produced in an electric furnace, aiming for a content of 1% each of nickel and chromium and 0.30% molybdenum. The product composition was, 0.09% C, 0.58% Mn, 0.007% P, 0.010% S, 0.31% Si, 1.05% Ni, 0.98% Cr, 0.30% Mo and 0.03% Al. Ingots from this heat were processed to ⅝, 1- and 2-inch-thick plates and to 24-inch-OD by 0.969-inch-wall seamless pipe (610 by 24.6 mm). Table V below gives the test results. It is significant to note that all products exceed a 65 ksi yield strength and a transverse Charpy V-notch energy absorption of 50 ft-lb and 50% shear-fracture appearance at −80°F.

TABLE V

| Mechanical Properties of Quenched and Tempered[2] Product | | | | |
|---|---|---|---|---|
| | Tensile Properties | | | |
| Product | Yield Strength, ksi | Tensile Strength, ksi | Elongation in 2 Inches, percent | Reduction of Area, percent |
| ⅝-Inch Plate | 78.8 | 91.4 | 26.0[3] | 70.2 |
| 1-Inch Plate | 73.6 | 88.1 | 25.5 | 73.5 |
| 2-Inch Plate | 65.9 | 82.4 | 28.5 | 76.4 |
| 0.969-Inch Wall Pipe | 73.9 | 88.0 | 26.5 | 77.8 |

CVN Tests at −80 F (−62 C)

Longitudinal Transverse

Shear- Shear-

TABLE V-continued

| Mechanical Properties of Quenched and Tempered[2] Product | | | | |
|---|---|---|---|---|
| | Tensile Properties | | | |
| Product | Yield Strength, ksi | Tensile Strength, ksi | Elongation in 2 Inches, percent | Reduction of Area, percent |
| Product | Energy Absorbed, ft-lb | Fracture Appearance, percent | Energy Absorbed, ft-lb | Fracture Appearance, percent |
| ⅝-Inch Plate | 120, 114, 106 | 100, 90, 90 | 74, 59, 86 | 70, 55, 90 |
| 1-Inch Plate | 148, 134, 157 | 65, 60, 100 | 126, 125, 156 | 70, 65, 100 |
| 2-Inch Plate | 201, 191, 208 | 100, 100, 100 | 140, 100, 116 | 60, 50, 55 |
| 0.969-Inch Wall Pipe | | | 176, 180, 175 | 100, 100, 100 |

[2]Plates were tempered in a 1275 F furnace for 1½ hours per inch of thickness and the pipe was tempered in a 1200 F furnace for 2 hours.
[3]Elongation in 1.4 inches (35.6 mm).

I claim:

1. A weldable low-alloy steel consisting of 0.06 to 0.12% carbon, 0.20 to 1.00% manganese, 0.15 to 0.40% silicon, 0.75 to 1.50% nickel, 0.50 to 1.25% chromium, 0.15 to 0.40% molybdenum, 0.010 to 0.060% aluminum, up to 0.75% copper with the total copper plus chromium not exceeding 1.50%, and the balance iron and conventional impurities.

2. A low-alloy steel according to claim 1 in which the chromium and copper contents are approximately 0.5 percent each.

3. A low-alloy steel according to claim 1 in which the nickel and chromium contents are approximately 1 percent each and the molybdenum content approximately 0.3 percent.

4. A low-alloy steel according to claim 1 which is characterized in the quenched and tempered condition by a minimum yield strength in excess of 60 ksi and a Charpy V-notch energy absorption of at least 50 ft-lb in both the longitudinal and transverse directions at −80°F.

5. A quenched and tempered low-alloy steel consisting essentially of 0.06 to 0.12% carbon, 0.20 to 1.00% manganese, 0.15 to 0.40% silicon, 0.75 to 1.50% nickel, 0.50 to 1.25% chromium, 0.15 to 0.40% molybdenum, 0.010 to 0.060% aluminum, 0.020% maximum phosphorus, 0.015% maximum sulfur, up to 0.75% copper with the total copper plus chromium not exceeding 1.50 percent, and the balance iron and conventional impurities, said steel characterized by a ferritic-pearlitic-bainitic microstructure having a minimum yield strength in excess of 60 ksi, and a Charpy V-notch energy absorption of at least 50 ft-lb in both the longitudinal and transverse directions at −80°F.

6. A quenched and tempered low-alloy steel according to claim 5 in which the chromium and copper contents are approximately 0.5 percent each.

7. A quenched and tempered low-alloy steel according to claim 5 in which the nickel and chromium contents are approximately 1% each and the molybdenum content approximately 0.3 percent.

* * * * *

UNITED STATES PATENT OFFICE

CERTIFICATE OF CORRECTION

Patent No. 3,955,971 Dated May 11, 1976

Inventor(s) Bartholomew G. Reisdorf

It is certified that error appears in the above-identified patent and that said Letters Patent are hereby corrected as shown below:

Column 6, Table IV- continued, lines 30-34 should be deleted.

Column 5, 6, 7 and 8, Table V should appear as shown on the attached sheet.

Signed and Sealed this

Thirty-first Day of August 1976

[SEAL]

*Attest:*

RUTH C. MASON
*Attesting Officer*

C. MARSHALL DANN
*Commissioner of Patents and Trademarks*

TABLE V

Mechanical Properties of Quenched and Tempered[2] Product

| Product | Tensile Properties: Yield Strength, ksi | Tensile Strength, ksi | Elongation in 2 Inches, percent | Reduction of Area, percent |
|---|---|---|---|---|
| 5/8-Inch Plate | 78.8 | 91.4 | 26.0[3] | 70.2 |
| 1-Inch Plate | 73.6 | 88.1 | 25.5 | 73.5 |
| 2-Inch Plate | 65.9 | 82.4 | 28.5 | 76.4 |
| 0.969-Inch Wall Pipe | 73.9 | 88.0 | 26.5 | 77.8 |

| Product | CVN Tests at -80 F (-62 C): Longitudinal Energy Absorbed, ft-lb | Longitudinal Shear-Fracture Appearance, percent | Transverse Energy Absorbed, ft-lb | Transverse Shear-Fracture Appearance, percent |
|---|---|---|---|---|
| 5/8-Inch Plate | 120, 114, 106 | 100, 90, 90 | 74, 59, 86 | 70, 55, 90 |
| 1-Inch Plate | 148, 134, 157 | 65, 60, 100 | 126, 125, 156 | 70, 65, 100 |
| 2-Inch Plate | 201, 191, 208 | 100, 100, 100 | 140, 100, 116 | 60, 50, 55 |
| 0.969-Inch Wall Pipe | | | 176, 180, 175 | 100, 100, 100 |

2) Plates were tempered in a 1275 F furnace for 1-1/2 hours per inch of thickness and the pipe was tempered in a 1200 F furnace for 2 hours.

3) Elongation in 1.4 inches (35.6 mm).